US011835188B2

(12) United States Patent
J N et al.

(10) Patent No.: US 11,835,188 B2
(45) Date of Patent: Dec. 5, 2023

(54) ELECTRIC LIGHTING APPARATUS

(71) Applicants: Vyasateja J N, Bangalore (IN); Dipal Navnitlal Gandhi, Cumming, GA (US)

(72) Inventors: Vyasateja J N, Bangalore (IN); Arun Kumar Murgan, Chennai (IN); Anil Ramesh K, Ernakulam (IN)

( * ) Notice: Subject to any disclaimer, the term of this patent is extended or adjusted under 35 U.S.C. 154(b) by 0 days.

(21) Appl. No.: 17/951,893

(22) Filed: Sep. 23, 2022

(65) Prior Publication Data

US 2023/0102286 A1 Mar. 30, 2023

Related U.S. Application Data

(60) Provisional application No. 63/248,971, filed on Sep. 27, 2021.

(51) Int. Cl.

| | |
|---|---|
| ***F21S 10/04*** | (2006.01) |
| *F21Y 113/10* | (2016.01) |
| *F21Y 115/10* | (2016.01) |

(52) U.S. Cl.
CPC ..... *F21S 10/043* (2013.01); *F21Y 2113/10* (2016.08); *F21Y 2115/10* (2016.08)

(58) Field of Classification Search
CPC ..... F21S 10/043; F21S 6/001
See application file for complete search history.

(56) References Cited

U.S. PATENT DOCUMENTS

| | | | | |
|---|---|---|---|---|
| 6,074,199 | A * | 6/2000 | Song | C11C 5/006 431/253 |
| 2015/0103520 | A1* | 4/2015 | Fournier | F21V 33/0056 362/190 |
| 2017/0122541 | A1* | 5/2017 | Patton | A61L 9/12 |
| 2020/0067331 | A1* | 2/2020 | McMurry | H02J 7/0045 |
| 2020/0248897 | A1* | 8/2020 | Johnson | F21S 6/001 |
| 2021/0270435 | A1* | 9/2021 | Chan | F21V 23/04 |
| 2021/0341118 | A1* | 11/2021 | Guerin | F21S 10/043 |
| 2022/0221119 | A1* | 7/2022 | Jacobson | A61L 9/122 |
| 2022/0412525 | A1* | 12/2022 | DeCosmo | F21V 23/04 |

* cited by examiner

*Primary Examiner* — Christopher E Dunay
(74) *Attorney, Agent, or Firm* — SAGE PATENT GROUP

(57) ABSTRACT

Embodiments of the present disclosure provides an electric lighting apparatus for stimulating at least one sensory effect on a user. The electric lighting apparatus comprises one or more light sources arranged to be in contact with a diffuser for causing diffusion of flameless light generated by the one or more light sources, wherein each of the one or more light sources is operable at a time interval. The electric lighting apparatus further comprises an aroma compartment being operable to dispense aroma while providing the diffused flameless light. The electric lighting apparatus further comprises an output unit being operable to provide an audio output, wherein the diffused flameless light, the aroma, and the audio output stimulate the at least one sensory effect on the user.

18 Claims, 11 Drawing Sheets

ELECTRIC LIGHTING APPARATUS

CROSS REFERENCE TO RELATED APPLICATION

This application is based on and derives the benefit of U.S. Provisional Application No. 63/248,971, filed on Sep. 27, 2021, the disclosures of which are incorporated herein by reference.

TECHNICAL FIELD

The present application relates generally to the field of lighting apparatus, and more specifically to an electric lighting apparatus providing a combination of diffused flameless light, aroma, and an audio output, which stimulate multiple senses of a user.

INTRODUCTION

Traditional lamps/candles use oil or ghee as a fuel source to produce light. However, usage of the traditional lamps can get messy due to chance of spillage of oil/ghee. Therefore, over the few decades, there are circumstances where people prefer wax candles over the traditional lamps. The wax candles offer a soft light that flickers with a slight air stream, which provides warm, romantic, and nostalgic atmosphere. However, the wax candles can be associated with variety of hazards, since the wax candles have open flames and the wax candles use a burning wicker for illumination. Examples of the hazards may include risk of fire, damage to surfaces caused by hot wax, and a possible emission of soot. Thus, flameless candles have become increasingly popular alternatives to the wax candles.

The flameless candles provide a long-lasting, safe, and clean alternative to the wax candles with no open flame or hot melted wax. The flameless candles may include electric powered candles (referred to as electric fameless candles), which use a heated element/wire designed to provide an illusion of a burning candle. However, such a heated element does not create an illusion of a real-flickering flame and may not be satisfactory for people who seek the appeal of the real wax candles.

In addition, the electric flameless candles cannot be adjusted in size in accordance with size requirements of a user. Thus, the user has to purchase multiple electric flameless candles with various sizes.

SUMMARY

Accordingly, exemplary embodiments of the present disclosure address these and other difficulties relating to available flameless candles.

An advantage of some embodiments is that an improved electric lighting apparatus is provided, which mitigates, alleviates, or eliminates all or at least some of the above-discussed drawbacks of presently known flameless candles.

An advantage of some embodiments is that the electric lighting apparatus provides a combination of diffused flameless light, aroma, and an audio output, which stimulate at least one sensory effect on a user.

An advantage of some embodiments is that the electric lighting apparatus comprises a diffuser for causing diffusion of flameless light generated by one or more light sources, wherein the diffused flameless light is a light mimicking to a natural candle.

An advantage of some embodiments is that the electric lighting apparatus provides aroma from an aroma pack using a fan. Thereby, eliminating a need of heater/vibrator for providing the aroma.

An advantage of some embodiments is that a shape and an inner scoop of the electric lighting apparatus is optimized for providing the audio output and a plurality of holes are provided on the electric lighting apparatus to ensure adequate audio output.

An advantage of some embodiments is that at least one parameter of the diffused flameless light/one or more light sources and the audio output are controlled in accordance with a control input received from the user, wherein the at least one parameter of the one or more light sources includes one or more of: brightness, colour, and at least one theme mimicking to natural phenomena. Thus, generating endless combinations that allow the user to set different moods in their living space.

An advantage of some embodiments is that the electric lighting apparatus provides a pre-built application for providing a pre-defined audio output, which stimulates the at least one sensory effect on the user.

An advantage of some embodiments is that the electric lighting apparatus may be easily integrated with a shell of multiple sizes using at least one fixing element. Thus, the user may be provided with multiple sizes of the shell to achieve a desired height of the electric lighting apparatus.

An advantage of some embodiments is that the electric lighting apparatus may be easily disintegrated from the shell by removing an attached base unit of the electric lighting apparatus from the shell, which provides a smaller size/original size of the electric lighting apparatus. As a result, the user may not compromise on a design/shape, a look and feel for premium finish and pleasing experience, and a functionality of the electric lighting apparatus.

Exemplary embodiments include an electric lighting apparatus for stimulating at least one sensory effect on a user. The electric lighting apparatus comprises one or more light sources arranged to be in contact with a diffuser for causing diffusion of flameless light generated by the one or more light sources, wherein each of the one or more light sources is operable at a time interval. The electric lighting apparatus further comprises an aroma compartment being operable to dispense aroma while providing the diffused flameless light. The electric lighting apparatus further comprises an output unit being operable to provide an audio output. The diffused flameless light, the aroma, and the audio output stimulate the at least one sensory effect on the user.

In some embodiments, the electric lighting apparatus further comprises a controller being operable to control the one or more light sources and the output unit.

In some embodiments, the electric lighting apparatus further comprises a base unit being integrated with a shell of at least one desired size to attain at least one desired height of the electric lighting apparatus.

In some embodiments, the one or more light sources comprise a plurality of light emitting diode (LED) lights emitting different colors.

In some embodiments, the plurality of LED lights is arranged on a LED panel in at least one row with a uniform spacing.

In some embodiments, the diffuser is made of a plastic with a frosted texture.

In some embodiments, the diffused flameless light is a light mimicking to a natural candle.

In some embodiments, the diffused flameless light is associated with one or more light themes mimicking natural phenomena, wherein the natural phenomena comprise one or more of: a candle light, a bonfire, a northern light, and a rainbow light.

In some embodiments, the electric lighting apparatus further comprises a flame ring being arranged to be in contact with the one or more light sources and the diffuser to provide different projections to the diffused flameless light.

In some embodiments, the aroma compartment comprises an aroma pack comprising one or more of: a gel, and a liquid chemical mixture, wherein the aroma compartment is being arranged to be in contact with a fan operable to dispense the aroma in a surrounding of the user using the aroma pack.

In some embodiments, the aroma compartment is accessed by the user using an aroma compartment tag employed with an in-out drawer mechanism.

In some embodiments, the output unit is operable to provide the audio output by receiving an audio request input for the audio output from the user through an application being executed on a user device in communication with the electric lighting apparatus.

In some embodiments, the electric lighting apparatus further comprises one or more of: at least one button being connected to the output unit to receive an audio control input from the user for controlling the output unit, and a plurality of holes through that the audio output is provided to the user.

In some embodiments, the controller is operable to control the one or more light sources by controlling at least one parameter of the one or more light sources. The at least one parameter of the one or more light sources comprises one or more of: brightness, color, and at least one theme mimicking to the natural phenomena.

In some embodiments, the controller is operable to control the at least one parameter of the one or more light sources by receiving a light control input indicating at least one parameter of the one or more light sources from the user through the application being executed on the user device in communication with the electric lighting apparatus.

In some embodiments, the base unit of the electric lighting apparatus is integrated with the shell using at least one fixing element.

In some embodiments, the at least one fixing element comprises one or more of: a snap fit, and magnetic fit points.

Other embodiments include an electric lighting system comprising an electric lighting apparatus being operable to cause diffusion of flameless light generated by one or more light sources, dispense aroma while providing the diffused flameless light, and provide an audio output, wherein the diffused flameless light, the aroma, and the audio output stimulate at least one sensory effect on a user. The electric lighting system further comprises a shell being connected to the electric lighting apparatus to attain a desired height of the electric lighting apparatus.

In some embodiments, the electric lighting system further comprises a user device being connected to the electric lighting apparatus to provide a control input for the electric lighting apparatus for controlling at least one parameter of the one or more light sources and the audio output.

Other embodiments include a method for stimulating at least one sensory effect on a user using an electric lighting apparatus. The method comprises causing diffusion of flameless light generated by one or more light sources arranged to be in contact with a diffuser, wherein each of the one or more light sources is operable at a time interval. The method comprises dispensing aroma while providing the diffused flameless light. The method comprises providing an audio output. The diffused flameless light, the aroma, and the audio output stimulate the at least one sensory effect on the user.

These and other objects, features, and advantages of embodiments of the present disclosure will become apparent upon reading the following Detailed Description in view of the Drawings briefly described below.

DETAILED DESCRIPTION

The embodiments herein, the various features, and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Figure 1:
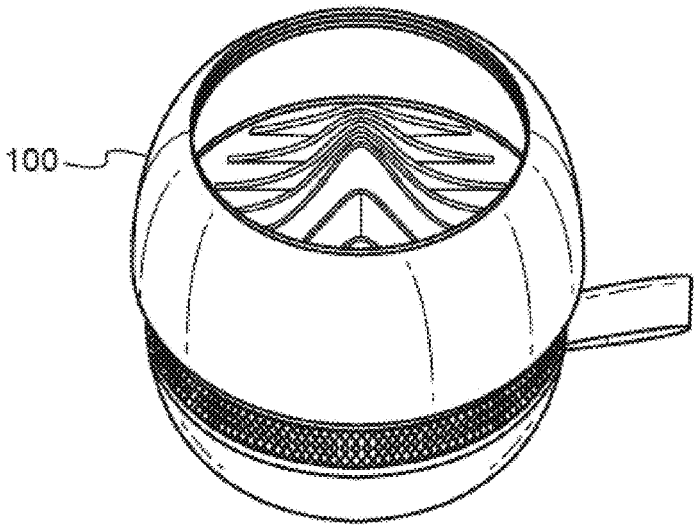
FIG. 1 shows an exemplary electric lighting apparatus, according to some embodiments.

FIG. 1 shows an exemplary electric lighting apparatus 100. The electric lighting apparatus 100 referred herein may be a flameless candle with no open flame or hot melted wax and clean alternative to wax candles.

According to some embodiments of the present disclosure, the electric lighting apparatus 100 is operable to stimulate at least one sensory effect on a user.

For stimulating the at least one sensory effect on the user, the electric lighting apparatus 100 comprises a diffuser 304 (depicted in FIGS. 3A-3D) being arranged to cause diffusion of flameless light generated by one or more light sources. In some embodiments, the one or more light sources comprise a plurality of Light Emitting Diode (LED) lights 504 (depicted in FIG. 5), each being operable at a time interval. In some embodiments, the diffuser is made of a plastic with a frosted texture. In some embodiments, the diffused flameless light is a light mimicking to a natural candle.

The electric lighting apparatus 100 also dispenses aroma while providing the diffused flameless light.

The electric lighting apparatus 100 also provides an audio output. In some examples, the audio output may include, but are not limited to, a music from a musical set, a sound effect for performing various activities such as yoga, meditation, or the like, an audio track for videos being streaming on a user device 506 (depicted in FIG. 5), and so on. In some examples, the audio output may be provided while providing the diffused flameless light. In some examples, the audio output may be provided irrespective of providing the diffused flameless light.

The diffused flameless light, the aroma, and the audio output stimulate at least one sensory effect on the user.

In some embodiments, the electric lighting apparatus 100 may also control the one or more light sources/diffused flameless light and the audio output.

In some embodiments, the electric lighting apparatus 100 may also provide a pre-built application, which may be executed to provide a pre-defined audio output for performing the various activities such as yoga, meditation, or the like.

Various components of the electric lighting apparatus 100 arranged to provide the diffused flameless light, the aroma, and the audio output are explained in conjunction with figures in later parts of the description.

Figure 2:
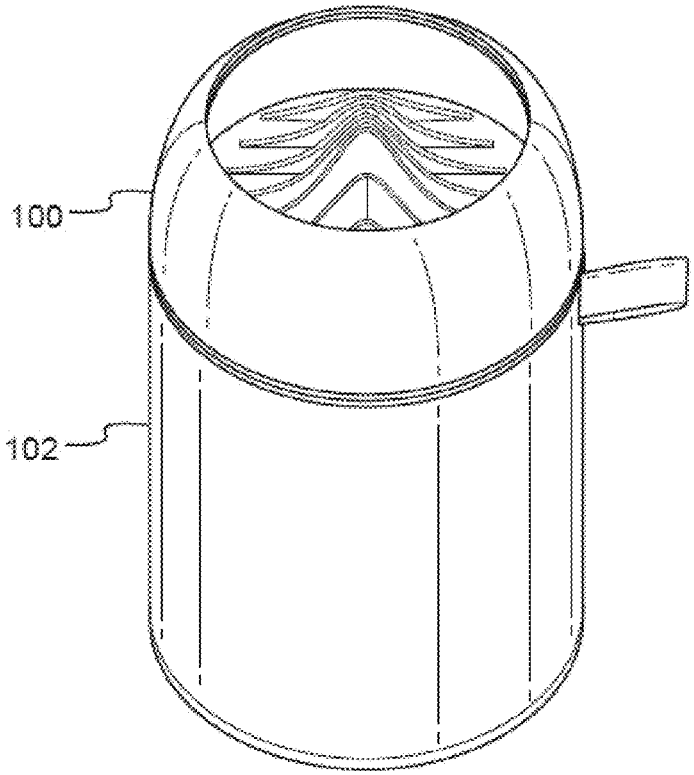
FIG. 2 shows an exemplary electric lighting apparatus integrated with a shell, according to some embodiments.

FIG. 2 shows the exemplary electric lighting apparatus 100 integrated with a shell 102, according to some embodiments. The electric lighting apparatus 100 comprises a base unit 415 (depicted in FIG. 4A) being integrated with the shell 102 of at least one desired size to attain at least one desired height of the electric lighting apparatus 100. Therefore, the user may convert or increase the height of the electric lighting apparatus 100 by integrating the base unit 415 with the shell 102.

In some embodiments, the base unit 415 of the electric lighting apparatus 100 may be integrated with the shell 102 using at least one fixing element. In some examples, the at least one fixing element may comprise one or more of: a snap fit, and magnetic fit points. Integration of the electric lighting apparatus 100 with the shell 102 is described in detail in conjunction with FIGS. 4A, 4B, 4C, and 4D.

Figure 3A:
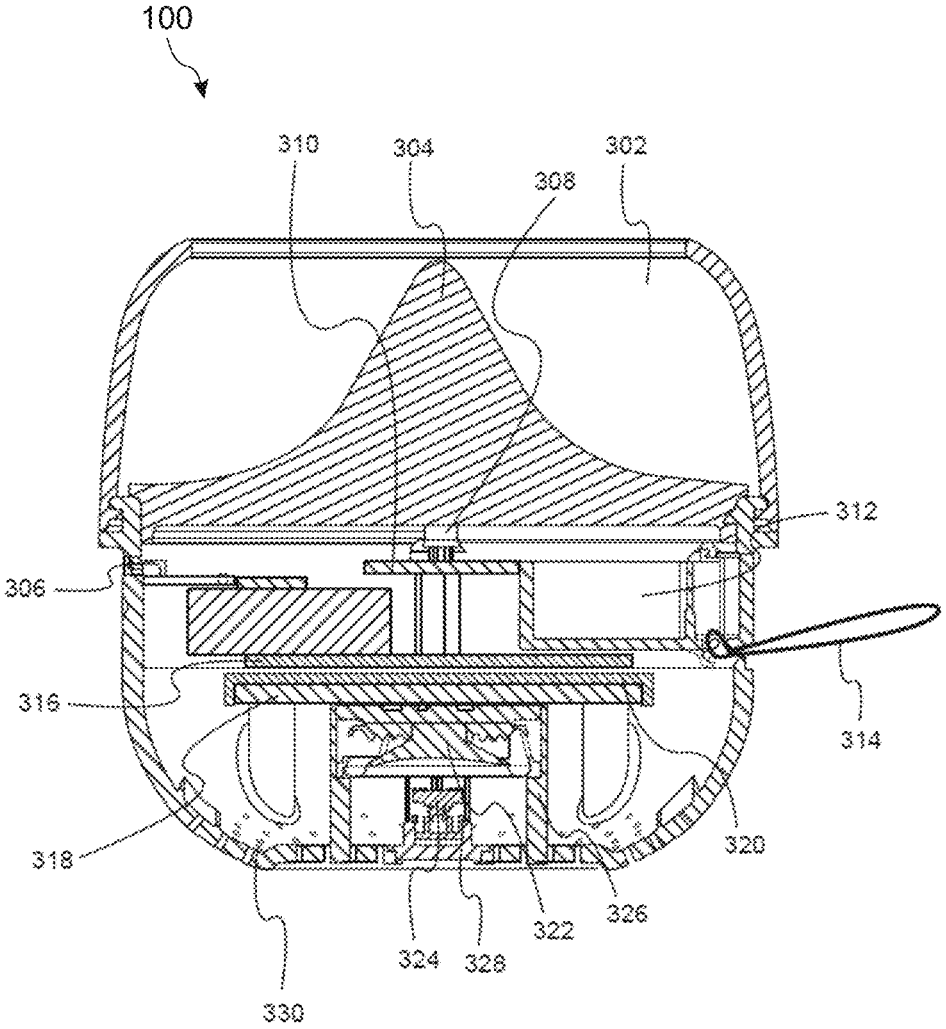
FIGS. 3A, 3B, 3C, and 3D show different perspective views of an electric lighting apparatus, according to some embodiments.

FIGS. 3A, 3B, 3C, and 3D show different perspective views of the electric lighting apparatus 100, according to some embodiments. A cross sectional view of the electric lighting apparatus 100 is depicted in FIG. 3A. As depicted in FIG. 3A, the electric lighting apparatus 100 comprises a LED panel 310, a LED row 308, the diffuser 304, a flame ring 302, an aroma compartment 312, an aroma compartment tag 314, an output unit 322, a button 324, an output unit housing 326, a button cover 328, holes 330 for the output unit 322, an Universal Serial Bus (USB) charging port 306, a controller 316, a battery 318, and a battery lock plate 320.

The LED panel 310 referred herein may be a plate on which the one or more light sources are incorporated. The one or more light sources being operable to generate the flameless light. In some embodiments, each of the one or more light sources is operable at a time interval to generate the flameless light. In some embodiments, the one or more light sources comprise a plurality of LED lights/LEDs 504 emitting different colors. In some embodiments, the plurality of LED lights 504 may be arranged on the LED panel 310 in a row using the LED row 308. It is understood that the plurality of LEDs 504 may be arranged in any other manner depending on a shape of the electric lighting apparatus 100.

The diffuser 304 may be arranged to be in contact with the one or more light sources to cause diffusion of the flameless light generated by the one or more light sources. In some embodiments, the diffuser 304 may be made of a plastic with a frosted texture. In some embodiments, the diffused flameless light is a light mimicking to a natural candle. In some embodiments, the diffused flameless light is associated with one or more light themes mimicking natural phenomena. In some examples, the natural phenomena comprise one or more of: a candle light, a bonfire, a northern light, and a rainbow light.

The flame ring 302 may be arranged to be in contact with the one or more light sources 504 and the diffuser 304 to provide different projections/flame projections to the diffused flameless light.

Figure 3B:
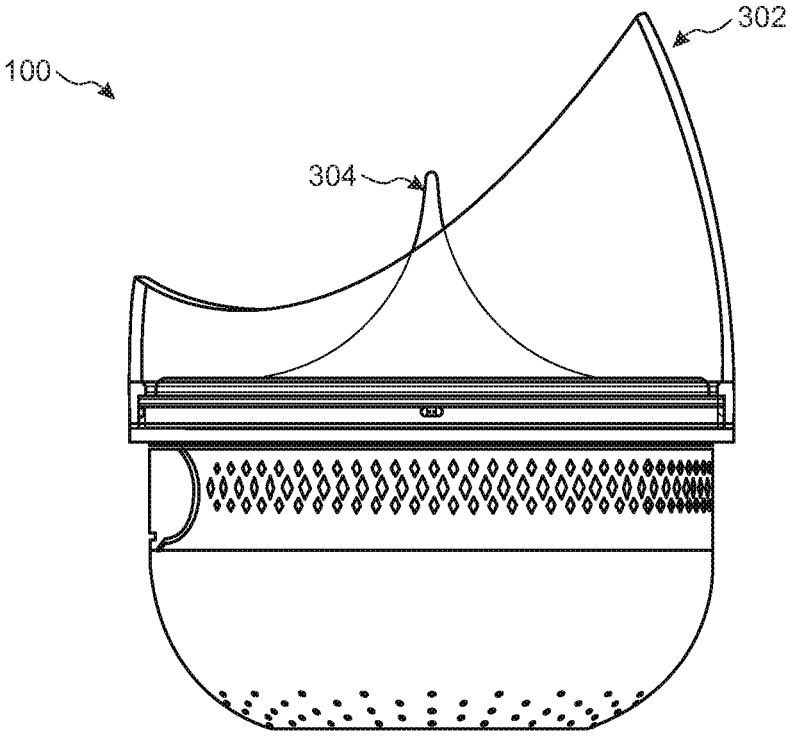
Figure 3C:
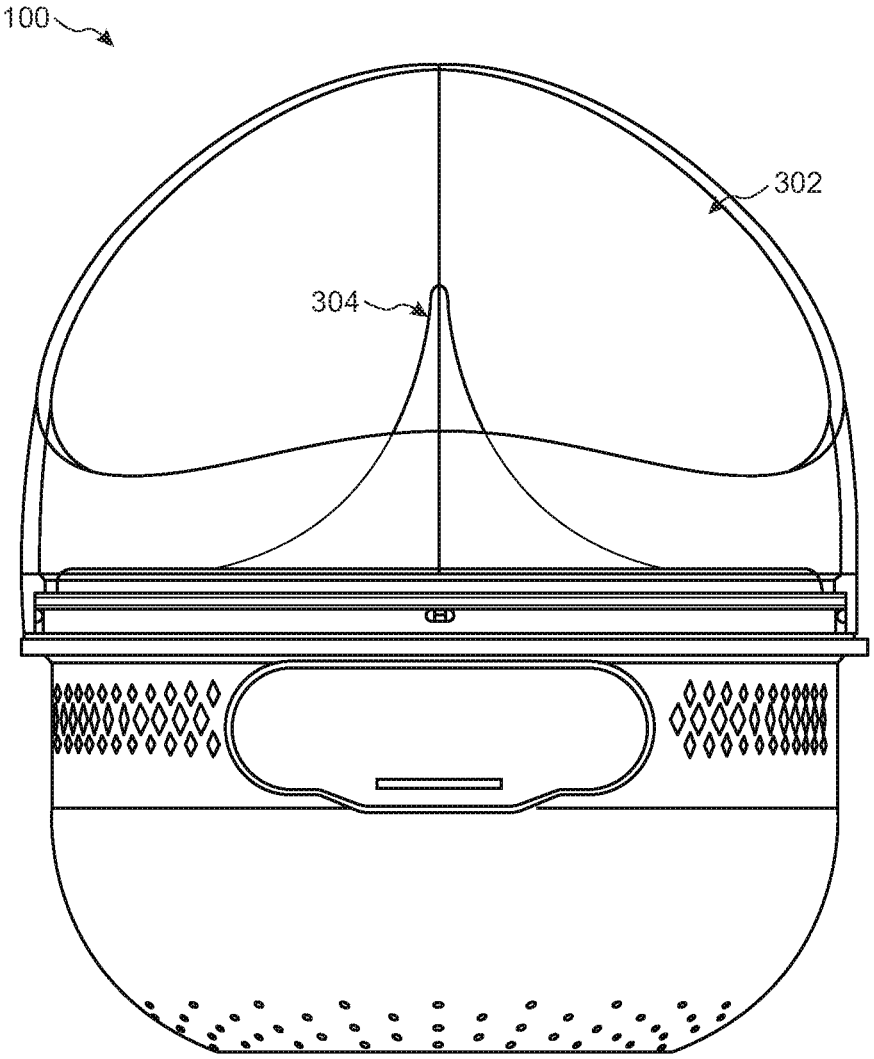
Figure 3D:
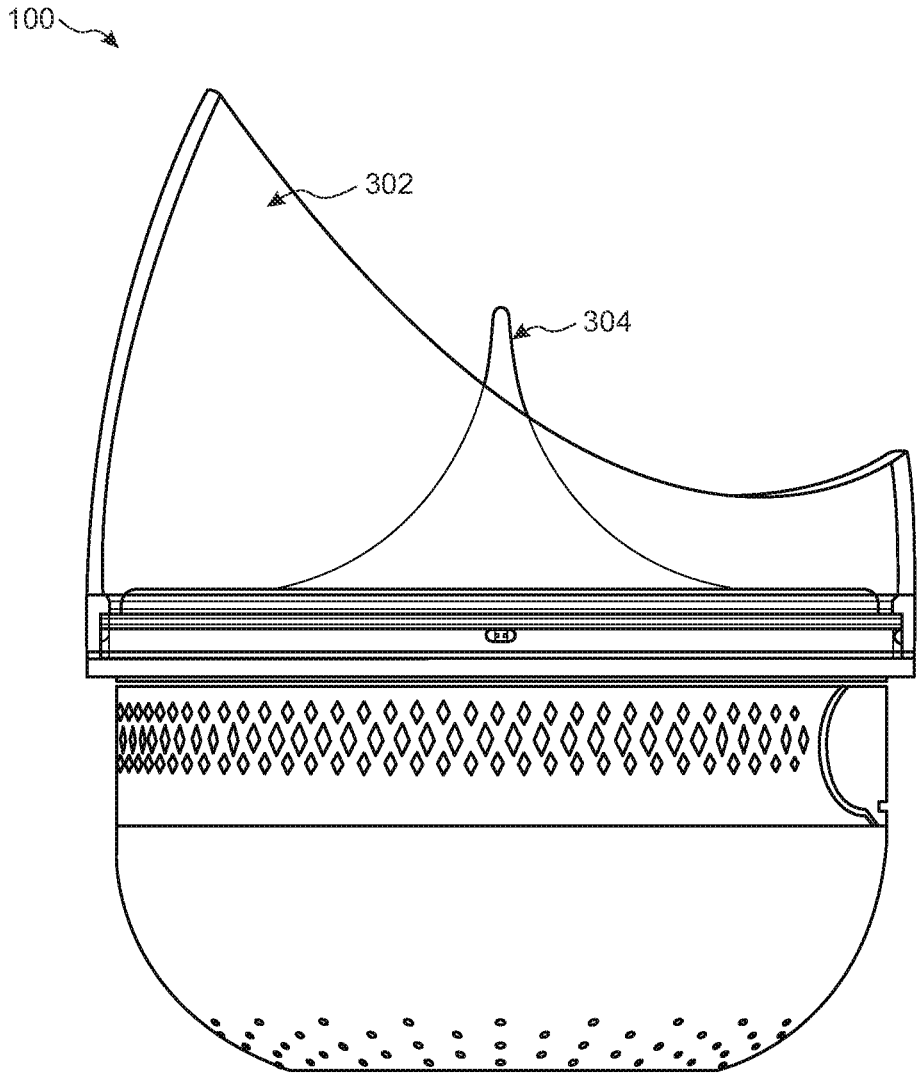

It should be noted that the diffuser 304 and the flame ring 302 may be designed in any configurable shape in accordance with a shape of the electric lighting apparatus 100. Thereby, aesthetic appearance of the electric lighting apparatus 100 may be improved. An exemplary configurable shape of the diffuser 304 and the flame ring 302 of the electric lighting apparatus 100 is illustrated in FIG. 3A. Another exemplary configurable shape of the diffuser 304 and the flame ring 302 of the electric lighting apparatus 100 is illustrated in FIGS. 3B, 3C, and 3D.

The aroma compartment 312 may be operable to dispense the aroma while providing the diffused flameless light. The aroma compartment 312 may comprise an aroma pack. In some examples, the aroma pack may comprise one or more of: a gel, and a liquid chemical mixture. In some embodiments, the aroma compartment 312 may be arranged to be in contact with a fan positioned inside the base unit 415 of the electric lighting apparatus 100. The fan may be used to dispense the aroma in a surrounding of the user from the aroma pack.

In some embodiments, the aroma compartment 312 may be accessible (i.e., opened and closed) by the user using the aroma compartment tag 314. The aroma compartment tag 314 may be employed with an in-out drawer mechanism.

The output unit 322 referred herein is operable to provide the audio output. In some examples, the output unit 322 may be a wireless speaker. In some examples, the audio output may include, but are not limited to, music, sound, or the like for performing one or more activities. In some examples, the activities may include, but are not limited to, yoga, meditation, and so on. In some examples, the audio output may include an audio track for video being played on the user device 506 being used by the user. In some examples, the output unit 322 may provide the audio output while providing the diffused flameless light. In some examples, the output unit 322 may provide the audio output independent of providing the diffused flameless light.

In some embodiments, the output unit 322 may provide the audio output by receiving an audio request input for the audio output from the user through an application being executed on the user device 506 in communication with the electric lighting apparatus 100.

In some embodiments, the electric lighting apparatus 100 may comprise the plurality of holes 330 for the output unit 322 through which the audio output may be provided. As a result, the user may hear the adequate audio output.

In some embodiments, the electric lighting apparatus 100 may comprise the button 324 arranged to be in contact with the output unit 322 to receive an audio control input from the user for controlling the output unit 322/audio output.

In some embodiments, the electric lighting apparatus 100 may comprise the output unit housing 326 being arranged to protect the output unit 322 from a physical damage.

In some embodiments, the electric lighting apparatus 100 may comprise the button cover 328 being arranged to protect the button 324 from the physical damage.

The controller 316 referred herein may be operable to control the one or more light sources and the output unit 322. In some examples, the controller 316 may include at least one of, but is not limited to, a central processing controller, a microcontroller, an electronics printed circuit board (PCB), or the like.

In some examples, the controller 316 may be associated with a communication unit 510 (depicted in FIG. 5) being operable to enable the communication between the electric lighting apparatus 100 and the user device 506 being used by the user. In some examples, the communication unit 510 may receive a control input from the user through the application being executing on the user device 506 and forward the control input to the controller 316. In some examples, the control input may include the audio control input for controlling the output unit 322/audio output. Controlling the output unit 322/audio output may involve at least one of: controlling (increasing/decreasing) sound of the audio output, changing the audio output, turning ON/OFF the output unit 322, and so on. In some examples, the control input may include a light control input indicating at least one desired parameter of the one or more light sources/diffused flameless light for controlling. In some examples, the at least one parameter of the one or more light sources may include, but are not limited to, brightness, color/hue, the at least one light theme mimicking to the natural phenomena, and so on.

Upon receiving the control input from the user, the controller 316 controls the at least one parameter of the one or more light sources and/or the audio output.

Consider an example scenario, wherein the user wants a sound effect to be provided by the output unit 322 of the electric lighting apparatus 100 for performing yoga. In such a scenario, the user provides the audio control input indicating the sound effect to be provided to the controller 316 through the application being executed on the user device 506. Upon receiving the audio control input from the user, the controller 316 controls the output unit 322 to provide the sound effect selected by the user.

Consider another example scenario, wherein the user wants to increase brightness and change a light theme associated with the diffused flameless light to a rainbow light. In such a scenario, the user provides the light control input indicating the desired brightness and the light theme (i.e., the rainbow light) to the controller 316 through the application being executed on the user device 506. Upon receiving the light control input, the controller 316 increases the brightness and changes the light theme associated with the diffused flameless light to the rainbow light by controlling the one or more light sources.

The battery 318 referred herein may be operable to provide a power supply to the components of the electric lighting apparatus 100 to operate. In some examples, the battery 318 may be charged using the micro USB charger 306 from a regular wall socket. In some examples, the battery lock plate 320 may be provided to hold the battery 318 for stability.

Figure 4A:
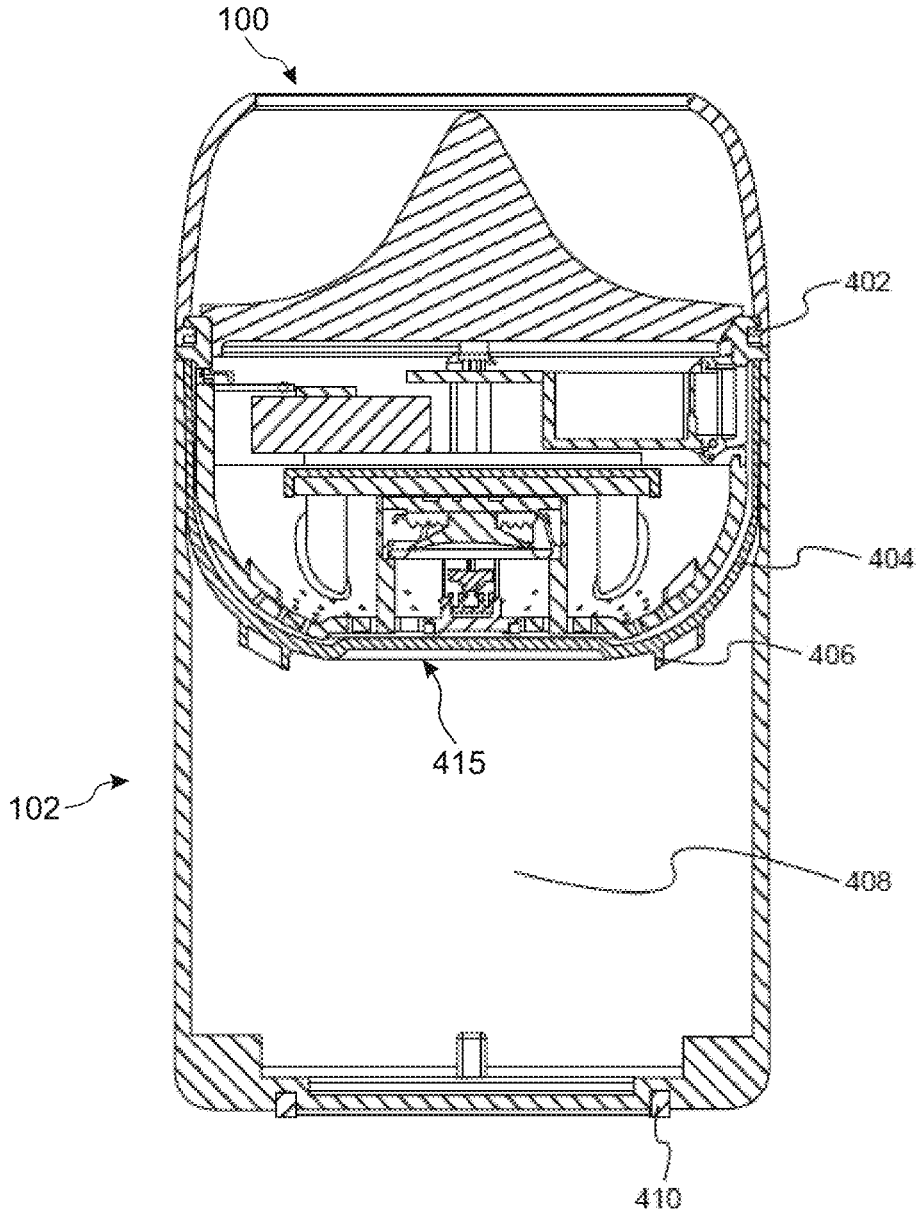
FIGS. 4A, 4B, 4C, and 4D show different perspective views of an electric lighting apparatus integrated with a shell, according to some embodiments.

FIGS. 4A, 4B, 4C, and 4D show different perspective views of the electric lighting apparatus 100 integrated with the shell 102, according to some embodiments. A cross sectional view of the electric lighting apparatus 100 integrated with the shell 102 is depicted in FIG. 4A. As depicted in FIG. 4A, the base unit 415 of the electric lighting apparatus 100 may be integrated with the shell 102 of at least one desired size to attain the desired height of the electric lighting apparatus 100. In some embodiments, the base unit 415 of the electric lighting apparatus 100 may be integrated with the shell 102 using the at least fixing element. In some examples, the at least one fixing element may include, but is not limited to, snap fit 402, magnetic fit points 406, or the like. The fixing element (snap fit, magnetic fit points, or the like) may be adapted to integrate the electric lighting apparatus 100 with the shell 102, so that the height of the electric lighting apparatus 100 may be increased.

In some embodiments, the shell 102 may comprise a shell housing 408 being arranged to hold the electric lighting apparatus 100.

In some embodiments, there exists an anti-skid ring 410, which may be attached to the base unit 415 of the electric lighting apparatus 100 being integrated with the shell 102. The anti-skid ring 410 ensures good grip while preventing accidental tip-overs of the electric lighting apparatus 100.

Figure 4B:
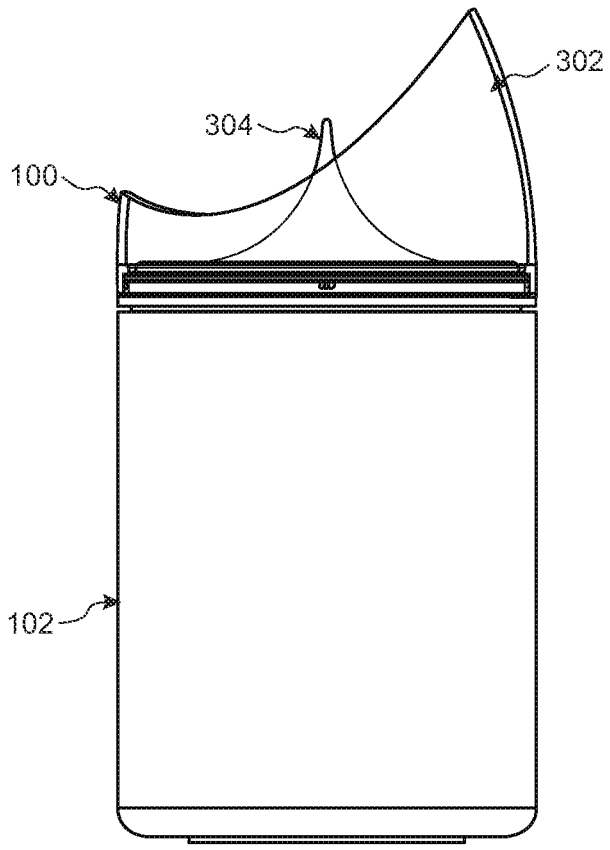
Figure 4C:
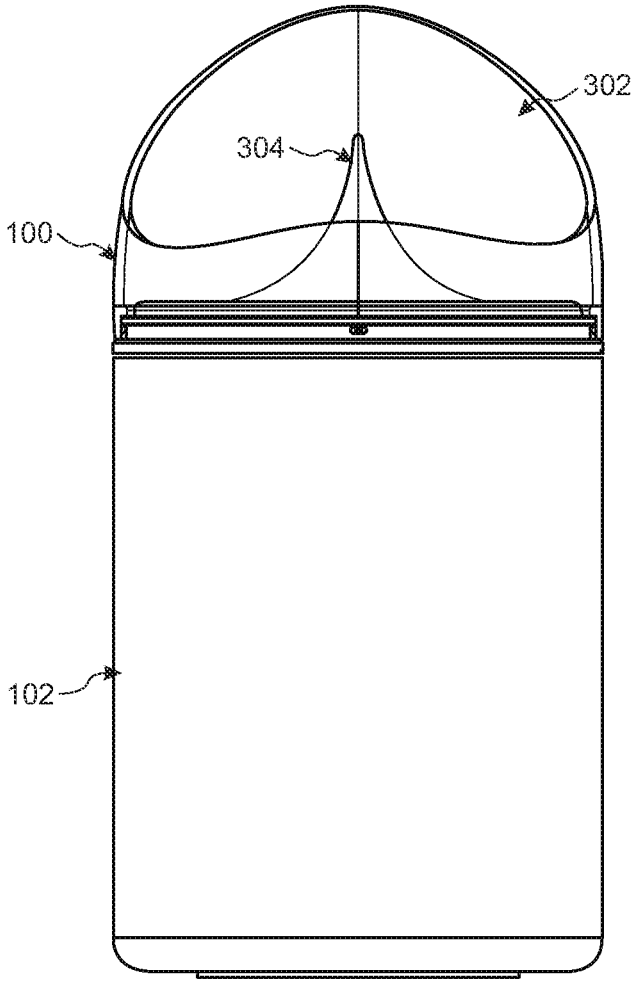
Figure 4D:
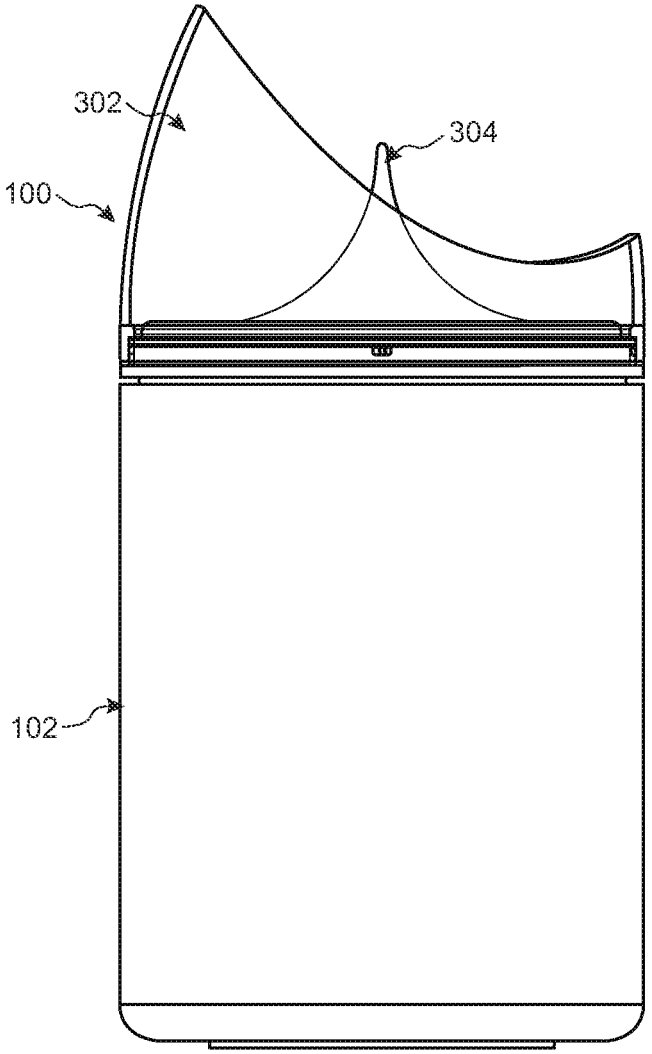

The electric lighting apparatus 100 integrated with the shell 102 comprises the diffuser 304, the flame ring 302, the aroma compartment 312, and the output unit 322 to provide the combination of the diffused flameless light, the aroma, and the audio output. An exemplary configurable shape of the diffuser 304 and the flame ring 302 of the electric lighting apparatus 100 integrated with the shell 102 is illustrated in FIG. 4A. Another exemplary configurable shape of the diffuser 304 and the flame ring 302 of the electric lighting apparatus 100 integrated with the shell 102 is illustrated in FIGS. 4B, 4C, and 4D. The different configurable shapes of the diffuser 304 and the flame ring 302 improve the aesthetic appearance of the electric lighting apparatus 100.

Figure 5:
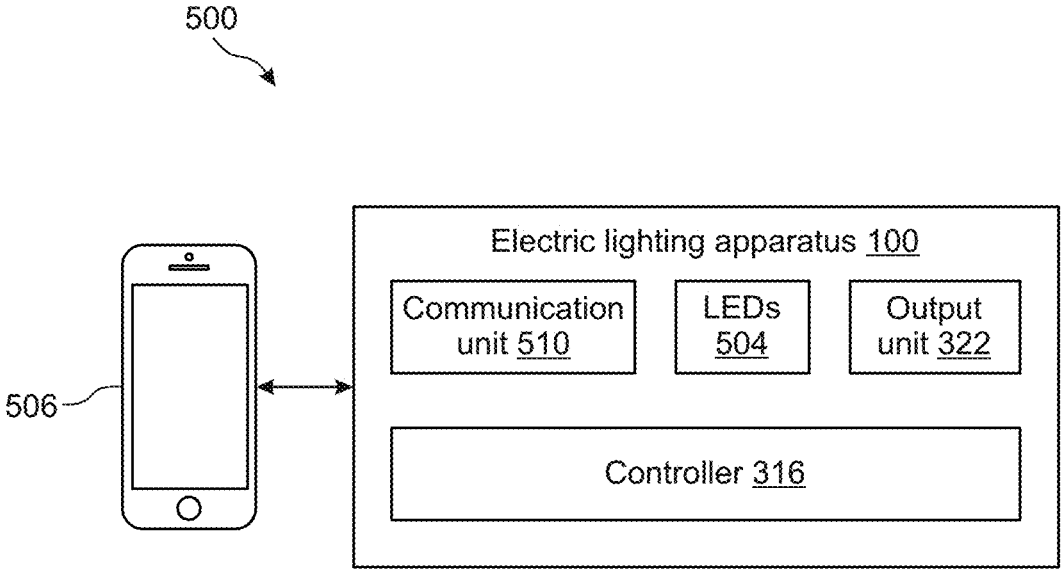
FIG. 5 shows an exemplary electric lighting system, according to some embodiments.

FIG. 5 shows an exemplary electric lighting system 500, according to some embodiments. As depicted in FIG. 5, the electric lighting system 500 comprises the electric lighting apparatus 100 and the user device 506.

The electric lighting apparatus 100 comprises the one or more light sources to generate the flameless light. The one or more light sources comprises the plurality of LED lights/LEDs 504 emitting different colors. In some examples, the plurality of LED lights 504 may be arranged in a row on the LED panel 310 (as described in detail in conjunction with FIG. 3A). In some embodiments, each of the one or more light sources is operable each at a time interval to generate the flameless light. The one or more light sources are arranged to be in contact with the diffuser 304 (as described in detail in conjunction with FIG. 3A), which causes diffusion of the flameless light generated by the one or more light sources. Thus, the electric lighting apparatus 100 provides the diffused flameless light mimicking to a natural candle. The diffused flameless light may be associated with different light themes mimicking natural phenomena such as, but are not limited to, a candle light, a bonfire, a northern light, a rainbow light, and so on.

The electric lighting apparatus 100 further comprises the aroma compartment 312 (as described in detail in conjunction with FIG. 3A) to dispense the aroma while providing the diffused flameless light.

The electric lighting apparatus 100 further comprises the output unit 322 to provide the audio output. In some examples, the output unit 322 provides the audio output upon receiving the audio request input from the user for the audio output.

Thus, the electric lighting apparatus 100 stimulates at least one sensory effect on the user by providing a combination of the diffused flameless light, the aroma, and the audio output.

The electric lighting apparatus 100 further comprises the controller 316 associated with the communication unit 510. The communication unit 510 may be operable to receive the control input from the user through the application being executed on the user device for controlling the parameters of the one or more light sources and the audio output. In some examples, the parameter of the one or more light sources may comprise brightness, color/hue, light theme mimicking to natural phenomena, and so on.

The controller 316 controls the parameters of the one or more light sources and the audio output in accordance with the control input received from the user. Controlling the one or more light sources/diffused flameless light, and the audio output generates endless combinations allowing the user to set different moods in a living space.

In some embodiments, the controller 316 may enable the output unit 322 to execute the pre-built application, which provides the pre-defined audio output (for example, sound/music for yoga, meditation, or the like). As a result, at least one sense of the user may be stimulated.

In some embodiments, the base unit 415 of the electric lighting apparatus 100 may be integrated with the shell 102 of multiple sizes to attain the desired height of the electric lighting apparatus 100. In some examples, the electric lighting apparatus 100 may be integrated with the shell 102 using at least one of: the snap fit 402, and the magnetic fit points 406. Therefore, the height/size of the electric lighting apparatus 100 may be increased seamlessly so that the user is not compromising on design, look and feel, and functionality of the electric lighting apparatus 100. The base unit 415 of the electric lighting apparatus 100 may be easily disintegrated from the shell 102 to attain an original height of the electric lighting apparatus 100.

The user device 506 referred herein may include, but are not limited to, a computing device, a multi-processor system, a microprocessor-based or programmable consumer electronic device, a network computing device, a minicomputer, or a combination thereof. In some examples, the computing device may include a cellular phone, a personal digital assistant, PDA, a handheld device, a laptop computer, a wearable device, or a combination thereof.

The user device 506 may execute the application through which the user may provide the control input to the electric lighting apparatus 100 for controlling the one or more light sources comprising the LED lights 504 and the output unit 322/audio output.

Figure 6:
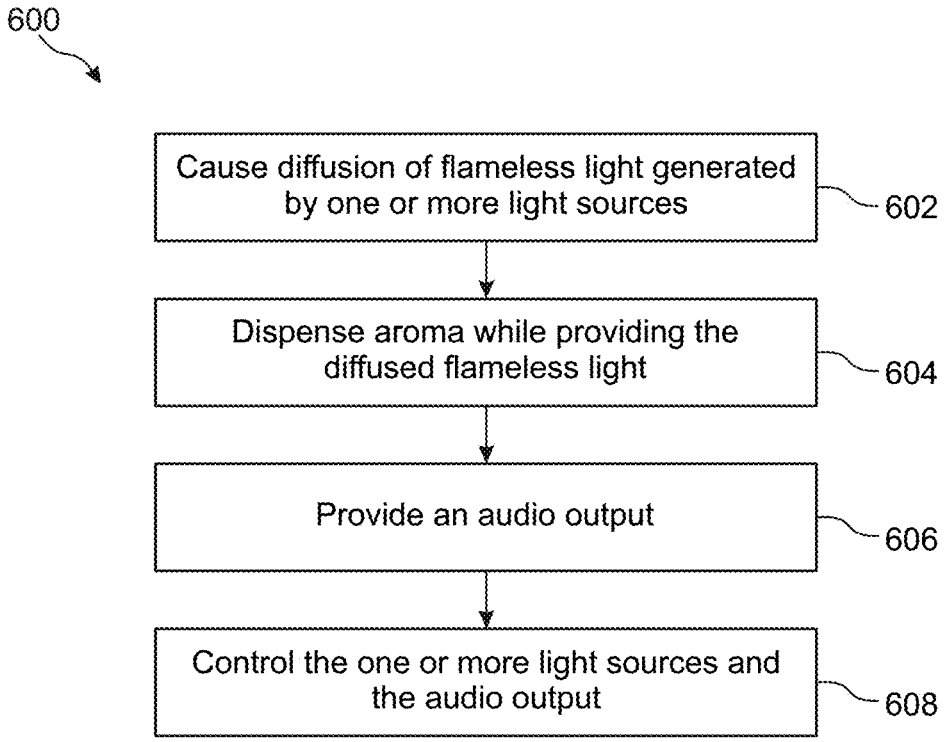
FIG. 6 is a flowchart illustrating example method steps of method performed for stimulating at least one sensory effect on a user using an electric lighting apparatus, according to some embodiments.

FIG. 6 is a flowchart illustrating example method steps of method 600 performed for stimulating the at least one sensory effect on the user using the electric lighting apparatus 100, according to some embodiments.

At step 602, the method 600 comprises causing diffusion of flameless light generated by one or more light sources arranged to be in contact with a diffuser. Each of the one or more light sources are operable at a time to generate the flameless light in different colors. In some embodiments, the diffuser 304 may be made of a plastic with frosted texture. In some embodiments, the diffused flameless light may be associated with the one or more light themes mimicking to the natural phenomena. In some embodiments, the diffused flameless light may be projected in different flame projections using the flame ring 302.

At step 604, the method 600 comprises dispensing aroma while providing the diffused flameless light. In some embodiments, the fan may be used to dispense the aroma from the aroma pack present in the aroma compartment 312. In some examples, the aroma pack may comprise one or more of: a gel, and a liquid chemical mixture.

At step 606, the method 600 comprises providing the audio output. In some embodiments, the audio output may include, but are not limited to, sound, music, audio tracks, and so on. The diffused flameless light, the aroma, and the audio output stimulate at least one sensory effect on the user.

At step 608, the method 600 comprises controlling the one or more light sources and the audio output. In some embodiments, the one or more light sources and the audio output may be controlled based on the control input (the light control input and/or the audio control input) received from the user through the application being executed on the user device 506. In some embodiments, controlling the one or more light sources comprises controlling the one or more parameters (such as, brightness, color/hue, light themes, or the like) of the one or more light sources.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the scope of the disclosure.

What is claimed is:

1. An electric lighting apparatus for stimulating at least one sensory effect on a user, the electric lighting apparatus comprising:

one or more light sources arranged to be in contact with a diffuser for causing diffusion of flameless light generated by the one or more light sources, wherein each of the one or more light sources is operable at a time interval, and the diffused flameless light is a light mimicking to a natural candle;

a flame ring being arranged to be in contact with the one or more light sources and the diffuser to provide different projections to the diffused flameless light;

an aroma compartment being operable to dispense aroma while providing the diffused flameless light; and an output unit being operable to provide an audio output, wherein the diffused flameless light, the aroma, and the audio output stimulate the at least one sensory effect on the user.

2. The electric lighting apparatus according to claim 1, wherein the electric lighting apparatus further comprises:

a controller being operable to control the one or more light sources and the output unit.

3. The electric lighting apparatus according to claim 2, wherein the controller is operable to control the one or more light sources by:

controlling at least one parameter of the one or more light sources, wherein the at least one parameter of the one or more light sources comprises one or more of: brightness, color, and at least one light theme mimicking to the natural phenomena.

4. The electric lighting apparatus according to claim 3, wherein the controller is operable to control the at least one parameter of the one or more light sources by:

receiving a light control input indicating at least one desired parameter of the one or more light sources from the user through the application being executed on the user device in communication with the electric lighting apparatus.

5. The electric lighting apparatus according to claim 1, wherein the electric lighting apparatus further comprises a base unit being integrated with a shell of at least one desired size to attain at least one desired height of the electric lighting apparatus.

6. The electric lighting apparatus according to claim 5, wherein the base unit of the electric lighting apparatus is integrated with the shell using at least one fixing element.

7. The electric lighting apparatus according to claim 6, wherein the at least one fixing element comprises one or more of: a snap fit and magnetic fit points.

8. The electric lighting apparatus according to claim 1, wherein the one or more light sources comprise a plurality of light emitting diode (LED) lights emitting different colors.

9. The electric lighting apparatus according to claim 8, wherein the plurality of LED lights is arranged on a LED panel in at least one row with a uniform spacing.

10. The electric lighting apparatus according to claim 1, wherein the diffuser is made of a plastic with a frosted texture.

11. The electric lighting apparatus according to claim 1, wherein the diffused flameless light is associated with one or more light themes mimicking natural phenomena, wherein the natural phenomena comprise one or more of: a candle light, a bonfire, a northern light, and a rainbow light.

12. The electric lighting apparatus according to claim 1, wherein the aroma compartment comprises:

an aroma pack comprising one or more of: a gel, and a liquid chemical mixture, wherein the aroma compartment is being arranged to be in contact with a fan operable to dispense the aroma in a surrounding of the user using the aroma pack.

13. The electric lighting apparatus according to claim 12, wherein the aroma compartment is accessed by the user using an aroma compartment tag employed with an in-out drawer mechanism.

14. The electric lighting apparatus according to claim 1, wherein the output unit is operable to provide the audio output by:

receiving an audio request input for the audio output from the user through an application being executed on a user device in communication with the electric lighting apparatus.

15. The electric lighting apparatus according to claim 14, wherein the electric lighting apparatus further comprises one or more of:

at least one button being connected to the output unit to receive an audio control input from the user for controlling the output unit; and a plurality of holes through that the audio output is provided to the user.

16. An electric lighting system, comprising:

an electric lighting apparatus being operable to:

cause diffusion of flameless light generated by one or more light sources, wherein the diffused flameless light is a light mimicking to a natural candle;

provide different projections to the diffused flameless light by a flame ring being arranged to be in contact with the one or more light sources and a diffuser;

dispense aroma while providing the diffused flameless light; and provide an audio output, wherein the diffused flameless light, the aroma, and the audio output stimulate at least one sensory effect on a user; and a shell being connected to the electric lighting apparatus to attain a desired height of the electric lighting apparatus.

17. The electric lighting system according to claim 16, wherein the electric lighting system further comprises a user device being connected to the electric lighting apparatus to provide a control input for the electric lighting apparatus for controlling at least one parameter of the one or more light sources and the audio output.

18. A method for stimulating at least one sensory effect on a user using an electric lighting apparatus, the method comprising:

causing diffusion of flameless light generated by one or more light sources arranged to be in contact with a diffuser, wherein each of the one or more light sources is operable at a time interval, and the diffused flameless light is a light mimicking to a natural candle;

providing different projections to the diffused flameless light by a flame ring being arranged to be in contact with the one or more light sources and the diffuser;

dispensing aroma while providing the diffused flameless light; and providing an audio output, wherein the diffused flameless light, the aroma, and the audio output stimulate the at least one sensory effect on the user.

* * * * *